United States Patent [19]

Durham

[11] Patent Number: 5,018,993

[45] Date of Patent: May 28, 1991

[54] WIRING DEVICE TERMINAL

[75] Inventor: Dwight H. Durham, Carrollton, Ga.

[73] Assignee: Southwire Company, Carrollton, Ga.

[21] Appl. No.: 532,550

[22] Filed: Jun. 4, 1990

[51] Int. Cl.[5] ..... H01R 4/30

[52] U.S. Cl. ..... 439/801; 439/817

[58] Field of Search ..... 439/791, 792, 793, 794, 439/801, 808, 809, 817, 818, 819, 868, 815; 24/662, 525

[56] References Cited

U.S. PATENT DOCUMENTS

| | | | |
|---|---|---|---|
| 804,232 | 11/1905 | Jackson | 439/819 |
| 818,480 | 4/1906 | Slusser | 439/817 |
| 821,029 | 5/1906 | Dow | 439/817 |
| 1,845,517 | 9/1930 | Pelton | 439/817 |

FOREIGN PATENT DOCUMENTS

| | | | |
|---|---|---|---|
| 0006023 | of 1884 | United Kingdom | 439/817 |

*Primary Examiner*—David L. Pirlot
*Assistant Examiner*—Hien D. Vu
*Attorney, Agent, or Firm*—James W. Wallis, Jr.; Stanley L. Tate; George C. Myers, Jr.

[57] ABSTRACT

An improved wiring device terminal which provides a constant and predetermined compressive securing force on an electrical conductor wire being terminated on such device and which responds to thermally induced variations of the electrical conductor's dimensions.

7 Claims, 1 Drawing Sheet

WIRING DEVICE TERMINAL

TECHNICAL FIELD

This invention relates to an improved wiring device. More particularly, this invention is directed to a wiring device terminal which provides means for applying a predetermined and uniform termination force to an electrical conductor as the dimensions of the conductor change with temperature variations.

BACKGROUND ART

There are currently two basic types of connectors found in common use with wiring devices, such as switches and receptacles, which are used in residential, commercial, and industrial applications.

The first type connector commonly found on such wiring devices is characterized by a screw which secures an electrical conductor to the wiring device. In such devices, the screw is threaded into a threaded hole within the electrical contact member of the wiring device. An electrical conductor is wrapped around the shank, or body, of the screw. The screw is then driven into the device. As the screw is driven into the device, the head of the screw presses the electrical conductor against the contact member of the device. With the conductor so secured to the device, it is then ready for service.

This method of terminating an electrical conductor on a wiring device provides certain advantages. One advantage is that a certain and firm contact is initially made between the electrical conductor being terminated and the electrical contact member of the wiring device. Another advantage of this configuration is the simplicity and low cost of manufacturing such a device.

However, the advantage of a firm initial contact cited above is also a distinct disadvantage. As electrical conductors are put under load, they heat up. As they heat up, they expand. Since the position of the screw, and therefore the screw head holding the conductor, is fixed, it does not expand with the conductor. The conductor expands against the connector screw head and plastic deformation of the relatively soft conductor results. After the electrical current load is removed, the conductor cools off. As the conductor cools off, it contracts creating a deformation space or gap between the surface of the conductor and the screw head. This space or gap results in decreased contact between the conductor and the connector. Less contact between the conductor and the connector results in more resistance at the connection. More resistance at the connection results in higher temperatures when the circuit is loaded again. Each cycle results in higher temperatures which in turn cause the conductor to flow and further deform with more dramatic results. Each time the cycle repeats, the resistance is increased, thereby resulting in an accelerated deterioration of the contact between the connector and the conductor, with catastrophic failure being the ultimate result.

A second type of connector has been developed to eliminate some of the problems created when the electrical conductor heats and expands. This type connection is commonly known as a "push-in" type system. This system utilizes a tooth-edge contact that is pressed against the conductor by means of a spring member rather than by a fixed screw head as described above. In this device, the connector is placed between the fixed surface of the contact member on the wiring device and a spring loaded, floating, tooth-edge securing member. Again, as the conductor is placed under load, it heats and expands. However, with the conductor secured to the wiring device by the floating, spring loaded member, there is no plastic deformation because the connector "gives" and moves with the conductor as the expanding conductor presses against the spring loaded connector member. Because the connector "gives" to accommodate conductor expansion, plastic deformation does not occur. When the load is removed, the conductor cools and contracts and the spring loaded member again reacts to changing conductor dimensions and remains in contact with the contracting conductor thereby eliminating the deformation induced gap that forms when screw type connectors are attached to a conductor. Because there is no deformation space or gap, there is no increase in the resistance of the connection and there is no accelerated deterioration of the connection.

One inherent disadvantage of the tooth-edge contact connector is that the conductor and the connector are in contact only at the points of the teeth, thereby resulting in only minimal contact between the conductor and the connector. Such a contact mechanism can result in conductor dislocation with a resultant connection deterioration or the complete severance of the junction formed by the wiring device and the electrical conductor.

DISCLOSURE OF THE INVENTION

It is therefore a primary object of the present invention to provide a wiring device that applies a constant and predetermined force to an electrical conductor connected to the device while preventing plastic deformation of the conductor as the conductor temperature increases with load.

It is another object of the present invention to provide a means for attaching an electrical conductor to a wiring device such that said conductor can be quickly and consistently connected thereto.

It is another object of the present invention to provide a wiring device that can be used by one having no special skills or training.

It is another object of the present invention to provide a wiring device that can be attached to an electrical conductor without special tools.

It is another object of the present invention to provide a means for securing an electrical conductor to a wiring device in such a way that the likelihood of conductor dislocation and accidental severance of the conductor-wiring device junction is substantially reduced or eliminated.

The principal feature of the present invention is the use of a retaining stud adapted to cooperate with a receptacle spring such that, when the stud and spring are correctly engaged, a predetermined constant force is applied to the conductor by the wiring device.

Another feature of the present invention is the constant force applied to the electrical conductor wire by the action of the receptacle spring which acts on the retaining stud.

Another feature of the present invention is the uniformity with which an electrical conductor can be attached to such a wiring device.

Another feature of the present invention is the ease with which even unskilled laborers can make proper electrical connections to such wiring devices.

The main advantage of the present invention is the uniformity with which electrical connections can be made to wiring devices.

Another advantage of the present invention is that it prevents the deterioration of electrical connections such as those experienced in a binding screw head type termination configuration.

Another advantage of the present invention is that a device so configured can be properly used without the necessity of utilizing specialized tools and equipment.

According to these and other objects, features, and advantages, there is provided a wiring device which provides for the application of a constant and predetermined binding force on an electrical conductor being connected thereto.

In the present invention, there is also provided an apparatus for connecting an electrical conductor to a wiring device such that said device will prevent plastic deformation of said conductor when the conductor expands as a result of load induced heating.

The present invention also comprises an apparatus for providing and maintaining constant, predetermined force on the retaining stud, the force being independent of any expansion which takes place when the electrical conductor expands as a result of load induced heating.

In the present invention, there is provided a means for applying a constant termination force to an electrical conductor, as the dimensions of said conductor change with temperature, said means comprising a stud retainer held in contact with said electrical conductor by means of a receptacle spring acting on a spiral cam slot in said stud retainer.

In the present invention, there is also provided a means for holding the retaining stud into contact with the electrical wire being terminated, said means comprising a retaining stud, said stud having a first or headed end and a second or cam slotted end and a receptacle spring, the slotted end of said retaining stud having a pair of cam surface slots which engage the receptacle spring. When the retaining stud is rotated, the cam surfaces of the cam surface slots draw the receptacle spring into tension and lock the stud such that reverse rotation is inhibited.

BRIEF DESCRIPTION OF THE DRAWINGS

These and other objects, features and advantages of the present invention will become more readily apparent as the description proceeds with the following more particular description of the preferred embodiment of the invention, the apparatus portions of which are illustrated in the accompanying drawing. The drawing is not necessarily to scale, emphasis instead being placed on illustrating the principles of the invention.

The figure is a cross-sectional view of the present invention showing the positional relationships of the major elements.

BEST MODE FOR CARRYING OUT THE INVENTION

Figure 1:
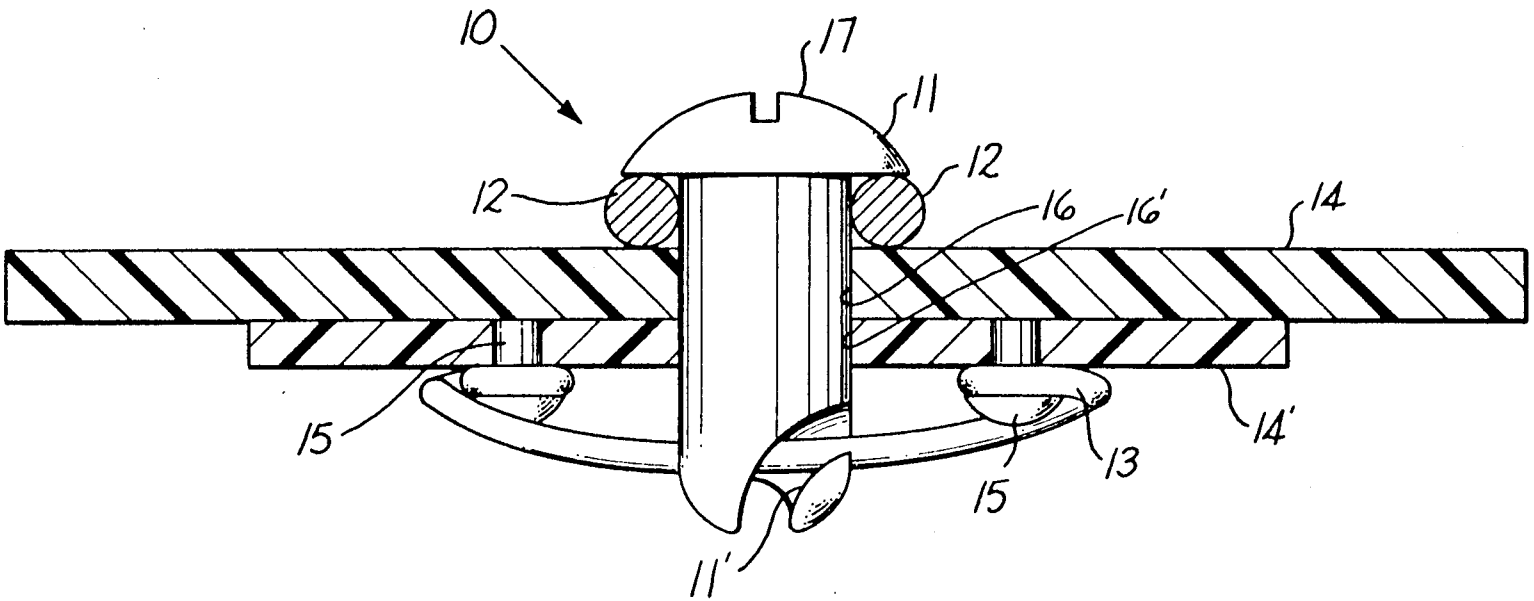

Referring to FIG. 1, the wiring device, generally indicated by the numeral 10, is illustrated in cross-section. In its simplest form, the device 10 comprises a slotted retaining stud 11, a front plate 14, a back plate 14', a spring 13 and a securing means 15. Front plate 14 and back plate 14' contain holes 16 and 16' which allow stud 11 to pass completely through. Spring 13 is attached to back plate 14' at two points by securing means 15 and extends across the opening of back plate hole 16' so that it is positioned to engage slot 11', said slot being a spiral cam in retaining stud 11. When in use, the flared head 17 of retaining stud 11 and front plate 14 engage conductor 12 which is held between flared head 17 and front plate 14 by a compressive force generated when stud 11 is rotated in a direction which causes spring 13 to engage a spiral cam surface of slot 11' which is cut into stud 11. Slot 11' is adapted to function in a cam like manner so that as spring 13 rides further up into slot 11' the compressive force applied to conductor 12 by flared head 17 and front plate 14 increases as the spring approaches the peak of the arc in slot 11' or the locked position. When spring 13 is in the locked position, any thermally induced expansion and contraction of conductor 12 is followed by both front plate 14 and stud 11 because both float in relation to each other as they follow the dimensional changes of conductor 12 during the cycle of load induced conductor expansion and contraction which occurs each time the device 10 is subjected to electrical load.

Although the invention has been discussed and described with primary emphasis on one embodiment, it should be obvious that adaptations and modifications can be made without departing from the spirit and scope of the invention.

What is claimed is:

1. A wiring device adapted to respond to thermally induced variations in the dimensions of an electrical conductor terminated thereon, comprising:

a retaining stud, said stud having a first, headed end and a second, slotted end, wherein said slotted end of said retaining stud comprises a spiral cam slot for engaging a means for imparting force on said electrical conductor and making electrical contact therewith; and a means for imparting holding force on said spiral cam slot of said retaining stud, said retaining stud being adapted to react to dimensional changes in said conductor and thereby prevent plastic deformation of said conductor.

2. The apparatus of claim 1, wherein said first or headed end of said retaining stud receives and secures said conductor and said spiral cam slot, acting in concert with said means for imparting force, forces said conductor into contact with said device plate.

3. The apparatus of claim 1, wherein said retaining stud passes through a device plate and said spiral cam engages said means for imparting holding force.

4. The apparatus of claim 3, wherein said means for imparting holding force on said spiral cam slot in said retaining stud comprises a spring.

5. The apparatus of claim 4, wherein said spring is an "S" shaped spring.

6. The apparatus of claim 5, wherein said spring is positioned such that it engages said spiral cam slot and imparts holding force on said retaining stud and pulls said stud to said device plate where said conductor is received and retained.

7. The apparatus of claim 6, wherein said retaining stud engages said spring by rotating said stud while said spring cooperates with said spiral cam slot.

* * * * *